United States Patent [19]

Kawasaki et al.

[11] 4,170,536

[45] Oct. 9, 1979

[54] ELECTROLYTIC CATHODE AND METHOD FOR ITS PRODUCTION

[75] Inventors: Keiji Kawasaki; Tetsuo Takeshita, both of Tokyo, Japan

[73] Assignee: Showa Denko K.K., Japan

[21] Appl. No.: 959,782

[22] Filed: Nov. 13, 1978

[30] Foreign Application Priority Data

Nov. 11, 1977 [JP] Japan ..... 52-134771
Nov. 18, 1977 [JP] Japan ..... 52-137795

[51] Int. Cl.[2] ..... C25B 11/06; C25B 1/34; C25D 5/48; C25D 3/12

[52] U.S. Cl. ..... 204/290 R; 204/35 R; 204/49; 204/98; 204/292; 204/293

[58] Field of Search ..... 252/477 Q; 204/290 R, 204/290 F, 290 K, 293

[56] References Cited

U.S. PATENT DOCUMENTS

| | | | |
|---|---|---|---|
| 2,928,891 | 3/1960 | Justi et al. | 252/477 Q |
| 3,061,525 | 10/1962 | Grazen | 204/9 |
| 3,503,799 | 3/1970 | Aoki et al. | 204/290 F |
| 3,595,762 | 7/1971 | Chessin | 204/38 R |
| 3,790,454 | 2/1974 | Henderson et al. | 204/49 |
| 3,846,344 | 11/1974 | Larson et al. | 252/466 J |
| 4,024,044 | 5/1977 | Brannan et al. | 204/242 |
| 4,089,812 | 5/1978 | O'Hare et al. | 252/466 J |

*Primary Examiner*—F. C. Edmundson
*Attorney, Agent, or Firm*—Wenderoth, Lind & Ponack

[57] ABSTRACT

A novel cathode for use in electrolysis of an aqueous solution of an alkali metal halide or water is provided which comprises a metallic cathode substrate and a powder of Raney nickel held on its surface partly embedded in a nickel layer deposited thereon from a nickel plating bath. The cathode has a considerably lower hydrogen overvoltage than ordinary cathodes. It can be produced by electrolytically depositing nickel on the surface of a metallic cathode substrate from an aqueous nickel plating bath containing a powder of Raney nickel suspended therein to form a co-deposited layer of the nickel and the Raney nickel powder.

10 Claims, No Drawings

ELECTROLYTIC CATHODE AND METHOD FOR ITS PRODUCTION

This invention relates to an improved cathode for use in electrolysis of an aqueous solution of an alkali metal halide or water, and to a method for its production. More specifically, it relates to an improved cathode consisting of a metallic cathode substrate and a powder of Raney nickel dispersed and firmly held on its surface to render its hydrogen overvoltage considerably lower than conventional cathodes, and to a method for its production.

It has been the wide industrial practice to produce hydrogen, halogen and sodium hydroxide by electrolysis of an aqueous solution of an alkali metal halide typified by sodium chloride, and to produce hydrogen and oxygen by electrolysis of water. The loss of power efficiency which is caused at this time by hydrogen overvoltages at the cathode is a serious problem from the standpoint of energy and cost. The hydrogen overvoltage at the cathode considerably varies according to the substrate of the cathode, the material which constitutes its surface, or the surface condition. It is known that when iron, stainless steel, nickel or a platinum-group metal is used as the substrate, a cathode having a comparatively low hydrogen overvoltage is obtained; and that the rougher the surface condition, the lower is the hydrogen overvoltage. Various cathodes have therefore been suggested which comprise a powder of a material having a low hydrogen overvoltage adhering to the cathode surface. They include, for example, a cathode coated with a nickel powder or a Raney nickel powder by a sintering method; a cathode obtained by depositing a powder of a metal such as nickel, cobalt, platinum or iron on the roughened surface of a metallic substrate by a flame or plasma spraying method (Japanese Laid-Open Patent Publication No. 32832/77; U.S. Ser. No. 611030 filed Sept. 8, 1975, now U.S. Pat. No. 4,049,841); a cathode having a coating of a mixture composed of cobalt powder and zirconia powder formed by flame or plasma spraying (Japanese Laid-Open Patent Publication No. 36582/77; U.S. Ser. No. 613320 filed Sept. 15, 1975, now U.S. Pat. No. 3,992,278); and a cathode having a coating resulting from the removal of an aluminum ingredient from a flame- or plasma-sprayed coating of a mixture consisting of particulate aluminum and nickel powder or cobalt powder or both (Japanese Laid-Open Patent Publication No. 36583/77; U.S. Pat. Ser. No. 613576 filed Sept. 15, 1975, now U.S. Pat. No. 4,024,044). All of these cathodes encounter various difficulties in their production. For example, it is difficult to form a uniform coating of a powdery material on a cathode substrate of a complicated surface configuration such as a metallic mesh, a lattice-shaped metallic mesh, or a cage-shaped metallic mesh (for example, Hooker-H type, or Diamond Shamrock-DS type). Or the loss of the powdery material is great, and causes economical disadvantage. Or the scattering of the powdery material causes environmental pollution. Or the adhesion of the powdery material is weak unless the surface of the metallic cathode substrate is roughened fully prior to the adhering operation.

According to this invention, there is provided a cathode for the electrolysis of an aqueous solution of an alkali metal halide and water which is free from the disadvantages of the various prior art cathodes described above and has a low hydrogen overvoltage.

The cathode of this invention consists of a metallic cathode substrate and a powder of Raney nickel or a partly developed Raney nickel alloy held on its surface dispersed and partly embedded in a nickel layer deposited thereon from an aqueous nickel plating bath.

As is well known, the Raney nickel alloy is an alloy composed of nickel and aluminum. Development, i.e. treatment with an alkaline solution to dissolve the aluminum ingredient, of this alloy gives Raney nickel.

The cathode substrate is selected from conductive metals which have the desired mechanical properties and the desired chemical resistance in electrolytic baths. Preferably, it is iron, stainless steel or nickel. The cathode may be plate-like, mesh-like, lattice-like, or of the shape of a cage in meshwork, or of any other complicated surface shapes.

The cathode of the invention can be produced by the following method with relative simplicity and commercial advantage.

The method for producing the cathode in accordance with this invention comprises electrolytically depositing nickel on the surface of a metallic cathode substrate from an aqueous nickel plating bath containing a powder of at least partly developed Raney nickel alloy suspended therein, thereby to form on said substrate surface a layer composed of a layer of the deposited nickel and the Raney nickel alloy powder dispersed and partly embedded in said nickel layer.

By nickel plating treatment of such a cathode substrate, the deposited nickel layer is firmly bonded to the substrate surface. At the same time, the powder of Raney nickel or partly developed Raney nickel alloy is codeposited, and partly embedded in the deposited nickel layer in the firmly held state.

The cathode of this invention can also be produced by performing the same nickel plating treatment as described above using a powder of an undeveloped Raney nickel alloy instead of the Raney nickel alloy which is at least partly developed, and then treating the resulting cathode with an aqueous alkali solution to dissolve and remove the aluminum ingredient from the codeposited undeveloped Raney nickel alloy powder.

Likewise, it is possible to treat a cathode obtained by nickel plating treatment in the presence of a powder of a partly developed Raney nickel alloy with an alkaline aqueous solution thereby to remove the remaining aluminum ingredient from the codeposited Raney nickel alloy powder to the desired degree, or almost completely.

The development, i.e. treatment with an alkaline aqueous solution, of the aluminum ingredient is well known in the field of Raney nickel alloy technology. There is no particular restriction on the type, composition and temperature of the alkaline solution used and the leaching time. In practice, suitable conditions are such that leaching is performed for about 1 hour or more by using an about 10–25% by weight aqueous solution of sodium hydroxide or potassium hydroxide at a temperature of about 25° to 80° C. The amount of the remaining aluminum will of course become smaller as the leaching time is longer. The use of a cathode having the lowest possible aluminum content in the nickel layer in the electrolysis of an aqueous solution of an alkali metal halide is preferred because it can minimize the inclusion of aluminum in the electrolysis products.

Preferably, the powder of Raney nickel or Raney nickel alloy used should have the smallest possible particle diameter to enable it to be well suspended in the nickel plating bath. Particles with a size of more than about 500 microns are not suited for practical operations because they are difficult to keep suspended in the nickel plating bath. Accordingly, the particle diameter of the powdery Raney nickel or Raney nickel alloy is generally less than 500 microns, preferably less than about 100 microns. Suspending of the powdery Raney nickel or Raney nickel alloy can be performed by any desired method, for example by stirring the plating bath mechanically or with the aid of gas bubbles, or by circulating the plating bath.

The amount of the powder to be suspended in the nickel plating bath is generally about 5 to 500 g/liter, preferably about 10 to 200 g/liter, in order to maintain a good suspended state, to attain uniformity of codeposition, to give a suitable amount of codeposition, and to secure economical advantage. The preferred amount of the powder to be suspended somewhat varies depending upon the electrolysis conditions of nickel plating. The amount can be smaller as the current density to be applied is higher.

If desired, an electroless plating bath may be used as the nickel plating bath. However, an electroplating bath is preferred because it permits easier and more uniform codeposition of a powder of Raney nickel or Raney nickel alloy. Conventional electroplating baths, such as a Watt's bath (an aqueous solution containing nickel sulfate and nickel chloride), an aqueous solution containing nickel borofluoride, and an aqueous solution containing nickel sulfamate, are used. The suitable pH of the bath is at least about 4, preferably about 5 to 7. In a bath which is too strongly alkaline or acidic, the aluminum ingredient of Raney nickel alloy reacts to hamper the electrolyzing operation, and the nickel ingredient in the bath is likely to precipitate.

The temperature of the plating bath may be those which are conventionally used, for example about 40° to 70° C., and there is no particular need to change it.

The amount of nickel deposited on the surface of the metallic cathode substrate and the amount of the Raney nickel powder codeposited in the nickel plating treatment depend upon the current density applied, and increase with higher current densities. To obtain a good codeposited layer of nickel and Raney nickel powder, current densities in the range of 2 to 20 A/dm$^2$, preferably 2 to 10 A/dm$^2$, should be applied. For practical purposes, the current density is preferably about 5 A/dm$^2$ or its vicinity. The amount of nickel deposited depends also upon the electrolyzing time. The thickness of the nickel layer deposited is not particularly restricted. But preferably, it is about 10 microns to 100 microns to form an especially desirable cathode.

As stated hereinabove, the cathode of this invention is of the structure in which a codeposit layer composed of nickel deposited from a nickel plating bath and a powder of a Raney nickel alloy at least partly developed is fixed firmly to the surface of a cathode substrate. Based on this structure, the cathode exhibits a considerably low hydrogen overvoltage.

When it is desired to strengthen the holding of the Raney nickel or Raney nickel alloy powder partly embedded in the nickel layer, the cathode having the codeposited layer may be further electroplated from a nickel plating bath not containing the powder to form a thin nickel layer on the codeposited layer. Generally, in the first nickel plating treatment for the formation of the codeposited layer, the fixing strength of the powder of Raney nickel or its alloy at the same current density is lower when the amount of the powder suspended in the plating bath is higher than when it is lower. In such a case, it is especially desirable to form a thin nickel coating atop the codeposited layer. The thin nickel coating should have a thickness of about 10 microns or less.

It has been found that when a cathode having such a nickel coating layer with a thickness of 10 microns or less is treated with an alkaline aqueous solution, the aluminum ingredient can be removed from the undeveloped or partly undeveloped Raney nickel alloy powder in the codeposited layer. This shows that the alkaline aqueous solution penetrates through the thin nickel layer. It has been discovered that a cathode having a nickel coating layer with a thickness of 10 microns or less atop the codeposited layer exhibits about the same low hydrogen overvoltage as a cathode not containing such a thin nickel coating.

Accordingly, a cathode having a codeposited layer composed of a powder of an at least partly developed Raney nickel alloy on the surface of a metallic cathode substrate and a nickel coating layer with a thickness of about 10 microns or less atop the codeposit layer, and a method for its production are also within the scope of this invention.

The nickel plating treatment for the formation of the codeposit layer in accordance with this invention can be performed easily by using a nickel anode and the cathode substrate as a cathode. The nickel plating bath, as in conventional baths, may contain a buffer such as boric acid or a surface active agent such as a polyoxyethylene alkylamine or alkyl imidazolium chloride. The same can be said with regard to a nickel plating bath for providing an additional thin nickel layer on the codeposit layer. The surface of the cathode substrate to be plated should desirably be cleaned prior to use by conventional means such as degreasing, etching or blasting taken either singly or in combination.

If an ordinary nickel powder is used instead of a powder of a Raney nickel alloy at least partly developed, the superior effects of the cathode of this invention cannot be produced.

The following Examples illustrate the present invention more specifically.

EXAMPLE 1

A cathode in accordance with this invention was produced and tested as described below.

| | | |
|---|---|---|
| Cathode substrate: | A mild steel mesh (100 mm × 100 mm, wire diameter 2.4 mm, pitch 4.5 mm) | |
| Plating bath: | Nickel sulfate | 240 g/liter |
| | Nickel chloride | 45 g/liter |
| | Boric acid | 30 g/liter |
| | Undeveloped Raney nickel alloy powder (size 10–50 microns) | |
| | No. 1-1 | 5 g/liter |
| | No. 1-2 | 10 g/liter |
| | No. 1-3 | 20 g/liter |
| | No. 1-4 | 50 g/liter |
| | pH 5 | |
| | Temperature | 70° C. |

Codeposit plating treatment:

The above cathode substrate and a nickel plate anode were placed in the above plating bath, and while suspending the undeveloped alloy powder by stirring the bath with the aid of nitrogen gas bubbles, a direct current at 5 Amp. was passed across the electrodes for 15 minutes.

Development:

The resulting cathode having a codeposited layer composed of the undeveloped Raney nickel alloy powder and nickel was dipped in a 25% by weight aqueous solution of sodium hydroxide at 70° C. until no hydrogen gas was seen to evolve. Thus, the aluminum ingredient was removed from the powder.

Application test:

Asbestos was caused to adhere to the mesh cathodes Nos. 1-1 to 1-4 produced by the above codeposition plating treatment and the development. Each of the asbestos diaphragm cathodes obtained was placed in an electrolytic cell in opposition to an anode composed of a titanium plate and a coating of ruthenium oxide. A saturated aqueous solution of sodium chloride was electrolyzed in the cell at a current density of 17 Amp./dm$^2$.

When the untreated cathode (control) was used, the cell voltage was 3.5 V. When the treated cathodes were used, the cell voltages decreased by the amounts shown below (a decrease in cell voltage from that of the control).

| | |
|---|---|
| No. 1-1 | 0.04 V |
| No. 1-2 | 0.14 V |
| No. 1-3 | 0.15 V |
| No. 1-4 | 0.15 V |

EXAMPLE 2

Cathodes were produced in the same way as in Example 1 except that a powder of developed Raney nickel alloy (size 10–50 microns) was used in an amount of 10 g/liter (No. 2-1), 20 g/liter (No. 2-2) and 50 g/liter (No. 2-3) instead of the undeveloped Raney nickel alloy suspended in the plating bath. The development of the cathode was not performed because the developed Raney nickel alloy powder was used.

Using the resulting cathodes, a saturated aqueous solution of sodium chloride was electrolyzed in the same way as in Example 1. The decreases in cell voltages from the control were as follows:

| | |
|---|---|
| No. 2-1 | 0.09 V |
| No. 2-2 | 0.11 V |
| No. 2-3 | 0.12 V |

EXAMPLE 3

Cathodes in accordance with this invention were produced and tested as described below.

Cathode substrate: A mild steel plate (50 mm×40 mm) whose surface was polished with 80 emery paper.

Plating bath: Same as in Example 1 but containing undeveloped Raney nickel alloy (particle diameter 10–50 microns) in an amount of 5 g/liter (No. 3-1), 10 g/liter (No. 3-2), 20 g/liter (No. 3-3) and 50 g/liter (No. 3-4).

Codeposit plating treatment:

The cathode substrate and a nickel plate anode (50 mm×40 mm) were placed in each of the nickel plating baths, and while suspending the undeveloped Raney nickel alloy powder by stirring it with the aid of nitrogen gas bubbles, a direct current at 1 Amp. was passed across the electrodes for 15 minutes.

Development: Same as in Example 1.

Measurement of hydrogen overvoltage:

Each of the cathodes Nos. 3-1 to 3-4 and a nickel plate anode were dipped in opposing positions in a cell containing a 10% by weight aqueous solution of sodium hydroxide. At 30° C., the cathode potential was measured at varying currents. The measurement was performed through a Luggin capillary using a saturated calomel electrode as a standard electrode. The results are tabulated below. The parenthesized figures show a decrease in hydrogen overvoltage by the cathode of the invention from the control (untreated cathode).

| Current | 2.0A | 3.6A | 6.0A |
|---|---|---|---|
| Cathode potential (V) | | | |
| Control (untreated cathode) | −1.42 | −1.47 | −1.50 |
| No. 3-1 | −1.40 (0.02) | −1.43 (0.04) | −1.46 (0.04) |
| No. 3-2 | −1.27 (0.15) | −1.31 (0.16) | −1.32 (0.18) |
| No. 3-3 | −1.26 (0.16) | −1.30 (0.17) | −1.31 (0.19) |
| No. 3-4 | −1.26 (0.16) | −1.29 (0.18) | −1.31 (0.19) |

The cathode of No. 3-4 and a nickel plate anode were placed face to face in an electrolytic cell, and water (containing 10% of sodium hydroxide) was electrolyzed in it at 50° C. and a current density of 17 Amp./dm$^2$. The cell voltage at this time was 0.17 V lower than that obtained when using the control cathode.

EXAMPLE 4

Codeposit plating was performed on a cathode substrate by using the same plating bath as in Example 3 except that the amount of the undeveloped Raney nickel alloy powder was changed to 100 g/liter (No. 4-1) and 200 g/liter (No. 4-2).

Each of the cathodes was placed in a nickel plating bath not containing a Raney nickel alloy powder, and a direct current at 0.5 Amp. was passed for 10 minutes to form a nickel coating having a thickness of less than 10 microns atop the codeposited layer.

Finally, the cathode was developed with an alkaline aqueous solution in the same way as in Example 3.

The potentials of the resulting cathodes were measured by the same method as in Example 3. The results are tabulated below.

| Current | 2.0A | 3.6A | 6.0A |
|---|---|---|---|
| Cathode potential (V) | | | |
| No. 4-1 | −1.25 (0.17) | −1.27 (0.20) | −1.27 (0.23) |
| No. 4-2 | −1.25 (0.17) | −1.27 (0.20) | −1.27 (0.23) |

When water was electrolyzed under the same conditions as described in Example 3 using the cathode of No. 4-2, the cell voltage was 0.19 V lower than that obtained with the control cathode.

EXAMPLE 5

Codeposit plating was performed on a mild steel cathode substrate by using the same plating bath as in Example 3 except that developed Raney nickel alloy powder (size 10 to 50 microns) was used in an amount of 10 g/liter (No. 5-1), 20 g/liter (No. 5-2) and 50 g/liter (No. 5-3). Since the developed Raney nickel alloy powder was used, the subsequent development was not performed.

The potentials of the resulting cathodes were measured in the same way as in Example 3, and the results are as follows:

| Current | 2.0A | 3.6A | 6.0A |
|---|---|---|---|
| Cathode potential (V) | | | |
| No. 5-1 | −1.31 (0.11) | −1.35 (0.12) | −1.38 (0.12) |
| No. 5-2 | −1.31 (0.11) | −1.34 (0.13) | −1.35 (0.15) |
| No. 5-3 | −1.31 (0.11) | −1.34 (0.13) | −1.37 (0.13) |

When water was electrolyzed under the same conditions as described in Example 3 using the cathode of No. 5-3, the cell voltage was 0.13 V lower than that obtained with the control cathode.

EXAMPLE 6

Codeposit plating was performed in the same way as in Example 5 except that the Raney nickel powder was used in an amount of 100 g/liter (No. 6).

In a nickel plating bath not containing the Raney nickel powder, a nickel coating having a thickness of less than 10 microns was formed atop the codeposited layer by passing a direct current at 0.5 Amp. for 8 minutes.

The potentials of the resulting cathode were measured in the same way as in Example 3. The results are as follows:

| Current | 2.0A | 3.6A | 6.0A |
|---|---|---|---|
| Cathode potential (V) | | | |
| No. 6 | −1.27 (0.15) | −1.29 (0.18) | −1.32 (0.18) |

When water was electrolyzed under the same conditions as described in Example 3 using the cathode of No. 6, the cell voltage was 0.17 V lower than the control cathode.

Comparative Example

Codeposit plating was performed in the same way as in Example 6 except that the plating bath contained 100 g/liter of a powder of ordinary nickel (diameter 10 to 50 microns) instead of the Raney nickel powder, and a direct current at 2 Amp. was passed for 5 minutes. Then, a nickel coating with a thickness of less than 10 microns was formed atop the codeposited layer in a nickel plating bath not containing the nickel powder by passing a direct current at 0.5 Amp. for 10 minutes.

The potentials of the resulting cathode were measured, and the results are shown below.

| Current | 2.0A | 3.6A | 6.0A |
|---|---|---|---|
| Cathode potential (V) | | | |
| | −1.38 (0.04) | −1.42 (0.05) | −1.44 (0.06) |

The cathode obtained in this Comparative Example shows only a far smaller degree of the decrease of hydrogen overvoltage than the cathode of Example 6.

EXAMPLE 7

A mild steel cathode substrate was subjected to codeposit plating treatment in the same way as in Example 3 except that a plating bath of the following formulation was used, and then developed in the same way as in Example 3, to form a cathode (No. 7).

Plating bath:

| | |
|---|---|
| Nickel sulfamate | 350 g/liter |
| Nickel chloride | 15 g/liter |
| Boric acid | 30 g/liter |
| Powder of undeveloped Raney nickel alloy | 100 g/liter |
| pH | 4 |
| Temperature | 50° C. |

The potentials of the resulting cathode were measured in the same way as in Example 3, and the results are shown below.

| Current | 2.0A | 3.6A | 6.0A |
|---|---|---|---|
| Cathode potential (V) | | | |
| No. 7 | −1.26 (0.16) | −1.29 (0.18) | −1.30 (0.20) |

When water was electrolyzed under the same conditions as in Example 3 using this cathode, the cell voltage was 0.16 V lower than that obtained with the control cathode.

What we claim is:

1. A cathode for use in the electrolysis of an aqueous solution of an alkali metal halide or water, comprising a metallic cathode substrate and a powder of an at least partly developed Raney nickel alloy held on its surface dispersed and partly embedded in a nickel layer deposited thereon from a nickel plating bath.

2. The cathode of claim 1 wherein the surface of the nickel plated layer having the Raney nickel alloy powder held therein has an additional nickel coating layer thereon having a thickness of less than about 10 microns.

3. The cathode of claim 1 wherein the metallic substrate is iron, stainless steel or nickel.

4. The cathode of claim 1 wherein the at least partly developed Raney nickel alloy powder has a diameter of less than 500 microns.

5. The cathode of claim 4 wherein the diameter of the powder is less than 100 microns.

6. A method for producing the cathode of claim 1, which comprises electrolytically depositing nickel on the surface of a metallic cathode substrate from an aqueous nickel plating bath containing suspended therein a powder of an at least partly developed Raney nickel alloy, thereby to form on the surface of the substrate a layer composed of the deposited nickel layer and the powder of the Raney nickel alloy partly embedded therein.

7. A method for producing the cathode of claim 1, which comprises electrolytically depositing nickel from an aqueous nickel plating bath containing suspended therein a powder of an undeveloped or partly developed Raney nickel alloy to form on the surface of the substrate a layer composed of the deposited nickel layer and the powder partly embedded therein, and then treating the resulting product with an alkaline aqueous solution to remove at least a part of the aluminum ingredient in the powder.

8. A method for producing the cathode of claim 2, which comprises electrolytically depositing nickel on the surface of a metallic cathode substrate from an aqueous nickel plating bath containing suspended therein a powder of an at least partly developed Raney nickel alloy thereby to form on the surface of the substrate a layer composed of the deposited nickel layer and the powder partly embedded therein, and electrolytically forming a nickel coating having a thickness of not more than 10 microns atop the resulting layer from an aqueous nickel plating bath not containing the powder.

9. A method for producing the cathode of claim 2, which comprises electrolytically depositing nickel on the surface of a metallic cathode substrate from an aqueous nickel plating bath containing suspended therein a powder of an undeveloped or partly developed Raney nickel alloy thereby to form on the substrate surface a layer composed of the deposited nickel layer and the powder partly embedded therein, then treating the resulting product with an alkaline aqueous solution to remove at least a part of the aluminum ingredient in the powder, and electrolytically forming a nickel coating having a thickness of not more than 10 microns on the surface of the product from an aqueous nickel plating bath not containing the powder.

10. A method for producing the cathode of claim 2, which comprises electrolytically depositing nickel on the surface of a metallic cathode substrate from an aqueous nickel plating bath containing suspended therein a powder of an undeveloped or partly developed Raney nickel alloy thereby to form on the substrate surface a layer composed of the deposited nickel layer and the powder partly embedded therein, thereafter electrolytically forming a nickel coating having a thickness of not more than 10 microns on the surface of said layer from an aqueous nickel plating bath not containing the powder, and then treating the resulting product with an alkaline aqueous solution to remove at least a part of the aluminum ingredient in the powder.

* * * * *